US012693102B1

(12) United States Patent
Short et al.

(10) Patent No.: US 12,693,102 B1
(45) Date of Patent: Jul. 28, 2026

(54) DEFLAGRATION DEVICE FOR UNDERWATER UNEXPLODED ORDNANCE

(71) Applicant: The United States of America as Represented by the Secretary of the Navy, Indian Head, MD (US)

(72) Inventors: John Short, King George, VA (US); Tim White, College Park, MD (US); Robert Bruner, Waldorf, MD (US); Christian Jewell, Hollywood, MD (US); Patrick Van Dam, Alexandria, VA (US); Daniel McCarthy, La Plata, MD (US); Gary Evans, Earlysville, VA (US); Hugh Burrell, King George, VA (US); Christopher Wilhelm, Port Tobacco, MD (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 586 days.

(21) Appl. No.: 18/445,378

(22) Filed: Aug. 9, 2023

(51) Int. Cl.
*F42B 33/06* (2006.01)

(52) U.S. Cl.
CPC ..... *F42B 33/067* (2013.01)

(58) Field of Classification Search
CPC ..... F42B 33/067
See application file for complete search history.

(56) References Cited

U.S. PATENT DOCUMENTS 3,159,102 A * 12/1964 Riedl et al. ..... F42B 3/22 102/305
3,724,372 A * 4/1973 Phillips ..... F42B 33/06 102/306
4,601,761 A * 7/1986 Proctor ..... F23D 14/54 239/433
5,140,891 A * 8/1992 Husseiny ..... F42B 33/06 89/1.13
5,223,661 A * 6/1993 Sabri ..... F42B 33/06 89/1.13
5,458,071 A * 10/1995 Tadmor ..... F23G 7/003 110/237
5,936,184 A * 8/1999 Majerus ..... F41H 11/12 102/306
6,220,166 B1 * 4/2001 Cherry ..... F42B 33/062 102/305
6,232,519 B1 * 5/2001 Eidelman ..... F42B 33/067 588/320

(Continued)

*Primary Examiner* — Michelle Clement
(74) *Attorney, Agent, or Firm* — Fredric J. Zimmerman

(57) ABSTRACT

An unexploded ordnance (UXO) mitigation device of the present invention includes an energy-focusing guide formed with deflagration chamber, and an upper housing connected to the energy-focusing guide. The upper housing is formed with an opening and a tapered void, so that the opening merges into the tapered void, and the tapered void merges into the deflagration chamber. An initiator is inserted into the opening and an energetic charge is placed into the tapered void in contact with the initiator. A snorkel can be attached to the upper housing to establish a transient chamber, which allows for complete detonation of the energetic charge. The complete detonation causes conversion of gas in the deflagration chamber to ionize into a plasma having a wave velocity sufficient for the plasma to deflagrate the UXO.

20 Claims, 4 Drawing Sheets

(56) References Cited

U.S. PATENT DOCUMENTS

| | | | | |
|---|---|---|---|---|
| 6,453,788 | B1 * | 9/2002 | Lebet | F41H 11/12 89/1.13 |
| 6,765,121 | B2 * | 7/2004 | Eidelman | C06B 21/0091 588/408 |
| 7,331,268 | B1 * | 2/2008 | Pangilinan | F42D 5/04 102/305 |
| 7,501,551 | B2 * | 3/2009 | Eidelman | F41H 11/12 89/1.13 |
| H2259 | H * | 7/2011 | Boswell | 102/305 |
| 8,037,828 | B1 * | 10/2011 | Jakaboski | F42B 1/02 102/305 |
| 8,371,224 | B1 * | 2/2013 | Boswell | F42C 19/0846 102/305 |
| 8,464,624 | B2 * | 6/2013 | Asahina | C06B 21/0091 86/50 |
| 8,505,427 | B2 * | 8/2013 | Wilson | F42D 5/04 89/1.13 |
| 8,677,902 | B1 * | 3/2014 | Rock | F41B 9/0046 89/1.13 |
| 10,458,770 | B1 * | 10/2019 | Wilhelm | F42B 33/067 |
| 2004/0097775 | A1 * | 5/2004 | Eidelman | F41H 11/12 588/319 |
| 2023/0408235 | A1 * | 12/2023 | Heaton | F42D 5/045 |

* cited by examiner

DEFLAGRATION DEVICE FOR UNDERWATER UNEXPLODED ORDNANCE

STATEMENT OF GOVERNMENT INTEREST

The invention described herein may be manufactured and used by or for the government of the United States of America for governmental purposes without the payment of any royalties thereon or therefor.

FIELD OF THE INVENTION

This disclosure relates to devices and methods for mitigation of unexploded ordnance (UXO). More particularly, this disclosure relates to the use of plasma generating devices to mitigate UXO in an underwater environment.

BACKGROUND OF THE INVENTION

Unexploded ordnance (UXO) presents complex and widespread humanitarian problems. Intra- and inter-national conflicts involve the use of various types of explosive weapons. Sometimes weapons such as bombs, grenades, and mortars fail to function as intended during deployment, leaving behind unattended and often highly sensitive UXO. Other latent weapons such as mines, especially landmines, may function properly, but remain inactivated during conflict. In each of these instances, the UXO/landmine presents a prevalent threat to unsuspecting civilians and military personnel.

Various techniques have been used in the destruction of mines and other UXO. One technique is to use shaped charges for driving a jet through the outer hull of a mine and into the primary mine explosive for consuming the explosive. Shaped charge devices have the drawback of requiring relatively large loads of explosive charge, which may be used for unintended, insidious purposes if an enemy or unauthorized personnel intercepts the shaped charge. Another technique comprises injecting a chemical into a mine to exothermically burn the primary mine explosive. Drawbacks to this chemical technique include chemical compatibility limitations (i.e., the injected chemical may not be capable of safely consuming the explosive), long chemical reaction times, and aggressive delivery techniques that may place the operator in peril.

Another technique known as sympathetic detonation involves detonation of an explosive device to create a shockwave for exploding nearby mines. Sympathetic detonation presents the risk of collateral damage and lacks adequate effectiveness. According to yet another technique, torches have been mounted above mines to burn through the casing and consume the explosive. However, torches may become propulsive, and have limited underwater applicability. And for any of these techniques, whether the end user is initiating a sympathetic detonation, or igniting a torch, or attempting to use a chemical reaction to deflagrate the ordnance, a step in the process can often involve a specific obstacle to overcome; the UXO deflagration process is occurring underwater.

In view of the above, it can be an object of the present invention to provide a UXO deflagration device and methods for use that can be adapted for use in on underwater UXO. Another object of the present invention can be to provide a UXO deflagration device (and methods for use) that can establish a temporary chamber for more efficient ignition of the device. Still another object of the present invention is to provide a UXO deflagration device (and methods for use) that can be activated remotely, and that is safe for the operator and relatively easy to manufacture and to use.

SUMMARY OF THE INVENTION

An unexploded ordnance (UXO) mitigation device according to several exemplary embodiments of the present invention can include an energy-focusing guide and an upper housing connected to the energy-focusing guide. The upper housing can be formed with an opening and a tapered void, so that the opening merges into the tapered void. The energy-focusing guide can be formed with a deflagration chamber the merges into the tapered void. An initiator can be inserted into the opening and an energetic charge can be placed by tamping or other means into the tapered void so that the energetic charge is in contract with the initiator.

The snorkel can have a straight part with a proximal end and a distal end, with the distal end merging into a curved part that terminates at a curved end. In some exemplary embodiments, a plug that can be inserted into the curved end. With this configuration, the snorkel can establish a transient or temporary initiator chamber to allow for complete robust activation of the initiator and energetic charge.

The energetic charge material can be selected from the group consisting of HMX, RDX, PETN, EGDN, NG, TNT, DADNE, NTO and TMZ, and can cooperate with the gas in the deflagration chamber to establish a plasma having shock wave with an initial detonation velocity at least 7 mm/usec. With this configuration, the shockwave can travel towards the distal end of the energy-focusing guide to penetrate the casing of an unexploded ordnance (UXO) to thereby deflagrate the UXO.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED WRITTEN DESCRIPTION OF THE EMBODIMENTS

Figure 1:
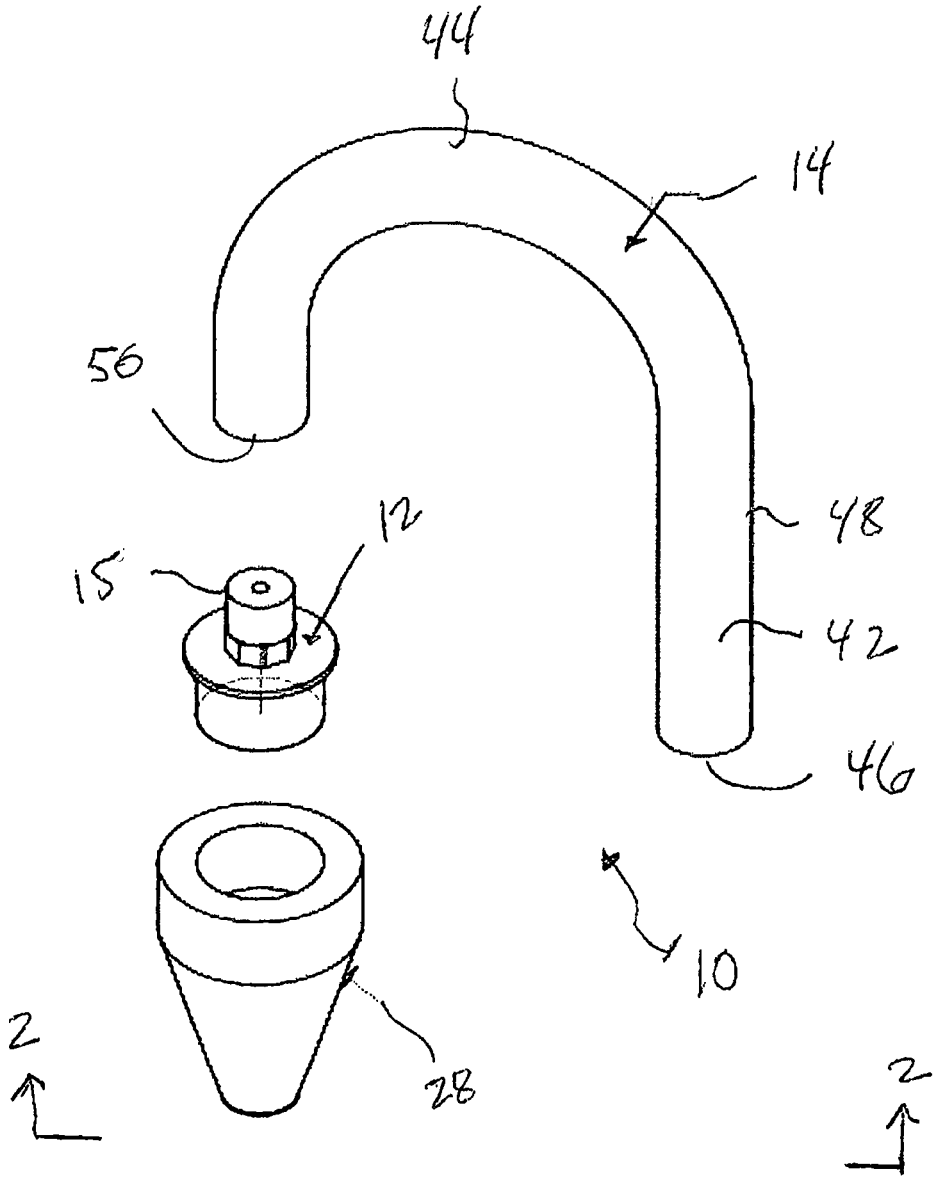
FIG. 1 is an exploded side elevational view of the deflagration device of the present invention according to several exemplary embodiments.
Figure 2:
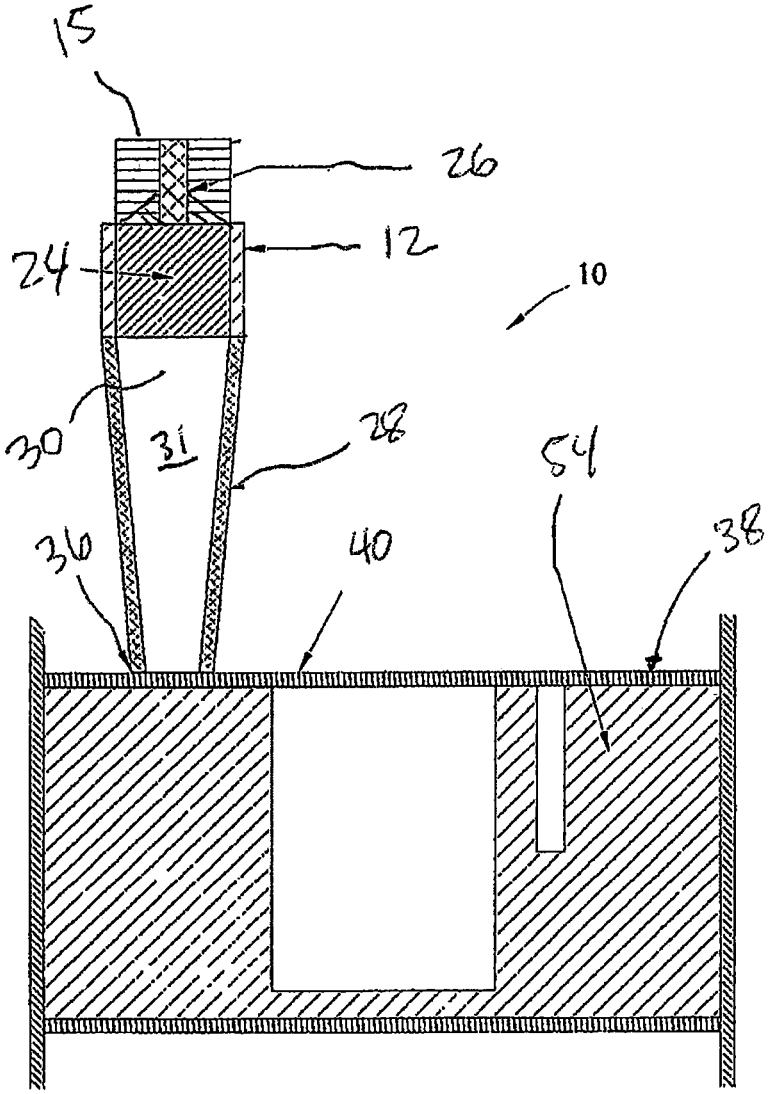
FIG. 2 is a cross-sectional view of the device of FIG. 1, taken along the line 2-2 in FIG. 1, when placed along on an unexploded ordnance (UXO) that is to be deflagrated.

Referring now more particularly to the drawings, and in particular to FIGS. 1-2, there is shown a mine/UXO-neutralizing device according to several exemplary embodiments, which can be represented by reference character 10. The device 10 can include an upper housing 12. An inverted snorkel 14 can attached to a post 15 on upper housing 12. Snorkel 14 can be threaded onto post 15, press-fit onto upper housing post 15, welded to upper housing post 15 or attached via other methods that are known in the art.

Figure 4:
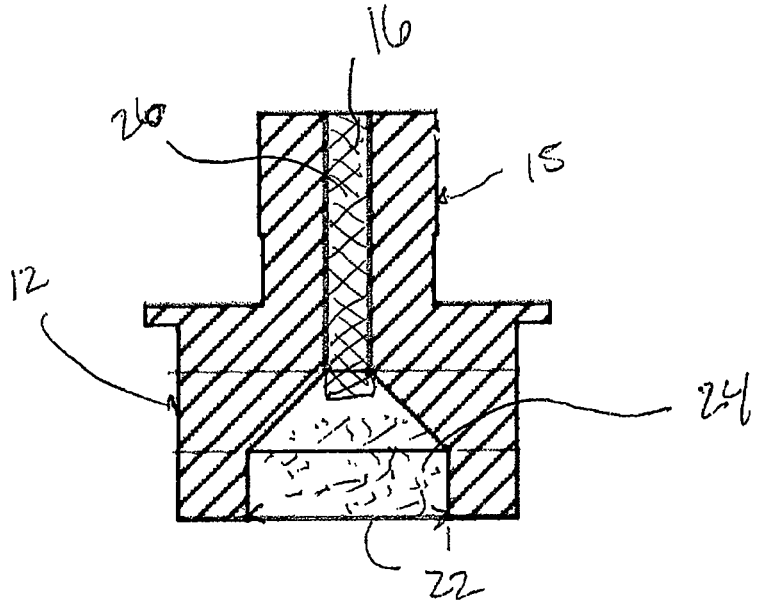
FIG. 4 is a cross-sectional view of the upper housing for the device of FIG. 2.

As shown in FIGS. 2 and 4, upper housing can be formed with an opening 16 that can merge into a conical tapered void 18, which can have an increase taper when viewed in cross-section, from a minimum width 20 proximate opening 16 to a maximum width 22 distal to said opening 16. As perhaps best seen in FIG. 2, an energetic charge 24 can be placed in tapered void 18, and an initiator 26 can be placed in opening 16 so that the initiator extends through opening 16 and into tapered void 18, where it can be in contact with the energetic charge 24 for detonation.

The energetic charge 14, in an exemplary embodiment, is pressable, although castable, pourable, or other charges may be used. The energetic charge 14, in an exemplary embodiment, includes a nitrate-containing compound, particularly in an amount of at least about 90 weight percent, and more particularly at least about 94 weight percent nitrate containing compound of the total weight of the charge 14. The nitrate containing compound may include one, two, three, or more nitrate groups, and in an exemplary embodiment, trinitro or higher. The nitrate containing compound may be selected, for example, from one or more of the following: a nitramine, such as 1,3,5-trinitro-1,3,5-triaza-cyclohexane (RDX), 1,3,5,7-tetranitro-1,3,5,7-tetraaza-cycloocatane (HMX), and 2,4,6,8, 10, 12-hexanitro-2,4,6,8, 10, 12-hexaaza-tetracyclo-[5. 5. 0. 05,903,11]-dodecane (CL-20); a nitrate ester, such as pentaerythritol tetranitrate (PETN), ethylene glycol dinitrate (EGDN), nitroglycerin (NG); and/or other nitrates, such as trinitrotoluene (TNT), 1,3,5-triamino-2,4,6-trinitrobenzene (TATB), 1,1-diamino-2,2-dinitro ethane (DADNE), and 3-nitro-1,2,4-triazol-5-one (NTO); and others, such as 1,3,3-trinitroazetidine (TNAZ); and combinations thereof.

The energetic charge 24, in an exemplary embodiment, may optionally include additional ingredients, such as oxidizers, binders, curing agents, plasticizers, and also may include small amounts of metal (e.g., aluminum) and carbon fuel. Examples of oxidizers may include nitrates and perchlorates, such as ammonium perchlorate. Non-energetic binders, energetic binders, or a combination thereof may be used. The binder may be plasticized or combination thereof may be used. The binder may be plasticized or unplasticized and may be selected from substituted or unsubstituted oxetane polymers, polyethers, and poly-caprolactones.

Representative binders that may be selected include, among others, hydroxy-terminated polybutadiene (HTPB), polypropylene glycol, polyethylene glycol, poly (glycidyl nitrate) (PGN), poly (nitratomethylmethyl-oxetane) ("poly-NMMO"), glycidyl azide polymer ("GAP"), diethyleneglycol triethyleneglycol nitraminodiacetic acid terpolymer ("9DT-NIDA"), poly(bisazidomethyl-oxetane) ("poly-BAMO"), poly-azidomethyl-methyloxetane ("poly-AMMO"), nitrocellose, polybutadieneacrylonitrile acrylic acid terpolymer ("PBAN"), and combinations and copolymers thereof. The binder formulations will generally include a curative appropriate for the binder. For example, a polyisocyanate curing agent is generally used with polyglycidyl nitrate, polyoxetanes, polyglycidyl azide, hydroxy-terminated polybutadienes, and polyethers, whereas an epoxy-curing agent is typically used with other binders such as PBAN.

Exemplary initiators 16 may include, for example, standard fuse cords, blasting cap (e.g. RP80), electric matches with lead lines, and other known and/or suitable initiators and detonators. In an exemplary embodiment, the initiator 16 is capable of remote activation to place the operator a safe distance from the ordnance.

Figure 3:
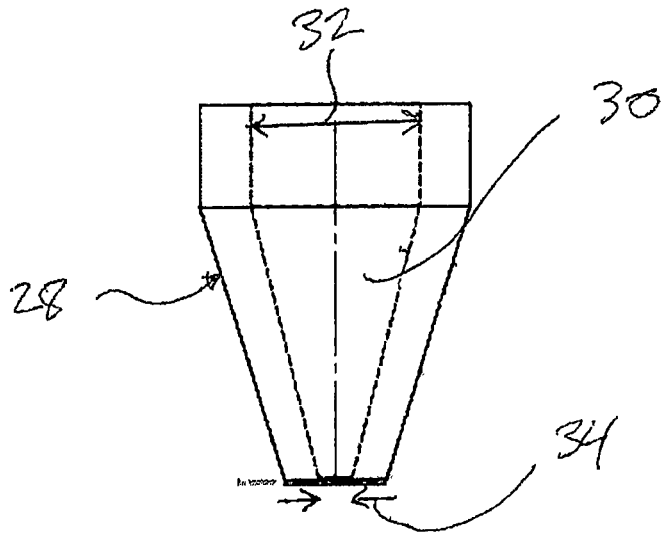
FIG. 3 is a cross-sectional view of the energy-focusing guide for the device of FIG. 2.

Referring now to FIGS. 2-3, the energy-focusing guide 28 can be seen in greater detail. As shown, energy-focusing guide 18 may be formed with a deflagration chamber 30 that can extend through the energy-focusing guide 18. The cross-sectional dimension of the deflagration chamber 30 can have a decreasing taper from a maximum chamber width 32 proximate energetic charge 24 to a minimum chamber width 34 distal to energetic charge 24, at end 36 of energy-focusing guide. It should be understood that other cross-sectional profiles/exemplary embodiments are possible, such as those include constant tapering and non-tapering profiles.

The upper housing 12 and the energy-focusing guide 28 may be made of the same or different materials, including, for example, metals, alloys, plastics, composites, paper and pulp products, etc. In an exemplary embodiment, the materials selected are compatible with the intended use environment (e.g., high or low temperature, underwater) of the device 10.

The deflagration chamber 30, in an exemplary embodiment, may be filled with an ionizable gas 31. Examples of suitable gases 31 that may be used for the purposes of this invention may include air, hydrogen, helium, argon, oxygen, and nitrogen, and combinations thereof. The device 10 of the present invention also may optionally include additional components. For example, according to an exemplary embodiment, a fuel component, such as aluminum or polytetrafluoroethylene (e.g., TEFLON®), may be placed at the distal guide end 36 of the guide 28. The fuel component may take the form of a sheet, foil, particles, etc. The device 10 also may include a holder, multi-leg support means (e.g. a tripod), bracket, stand, or other mounting apparatus (not shown in the Figures) for mounting the device 10 to unexploded ordnance (UXO) 38. Optionally, a sealant (e.g., O-ring or epoxy) may be used to form a hermetic seal between the distal end 36 of energy-focusing guide 24 and the casing 40.

Figure 5:
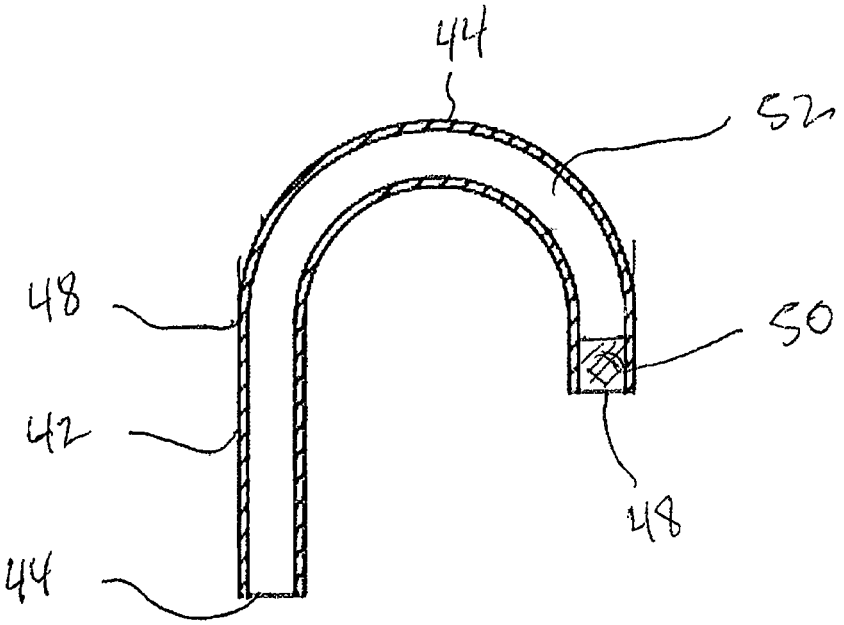
FIG. 5 is a cross-sectional view of the snorkel for the device of FIG. 1; and, FIG. 6 is a block diagram, which depicts steps that can be taken to practice the methods of the present invention according to several embodiments.
Figure 6:
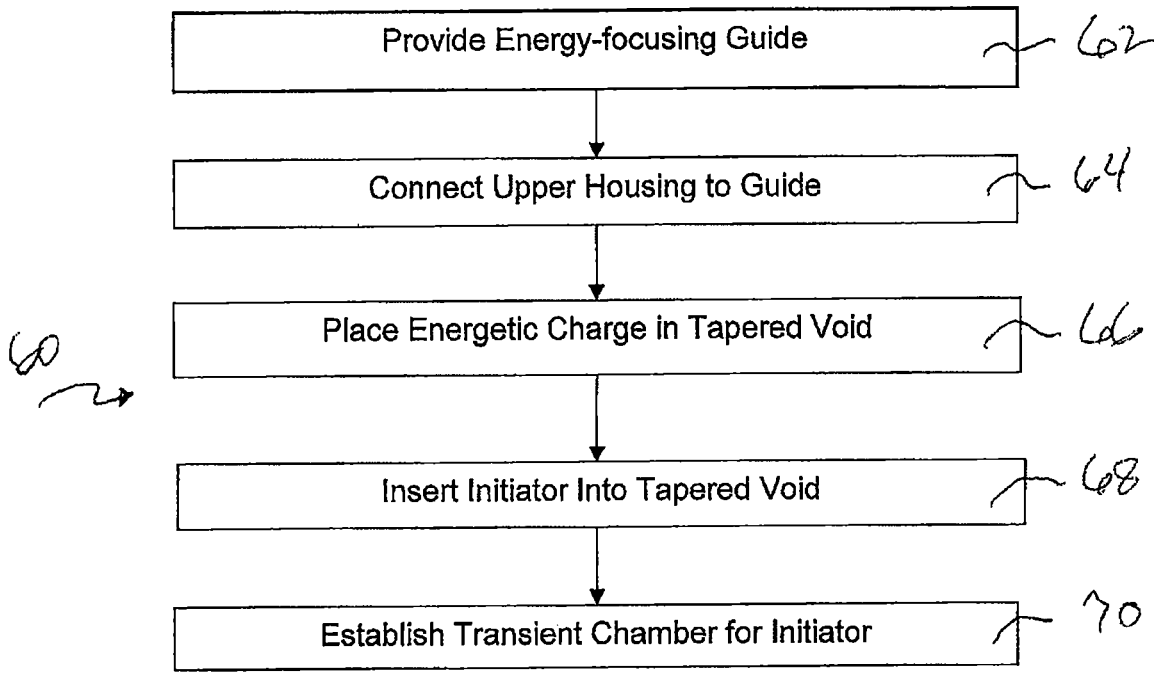

Referring now to FIGS. 1 and 5, the snorkel 14 can be seen in greater detail. As shown in an exemplary embodiment, snorkel 14 may be formed with a straight part 42 that merges into a curved part 44. The straight part 42 can have a proximal end 46 and a distal end 46. Straight part 42 merges into curved part 44 at distal end 46. Curved part 46 can terminate at curved end 48. In some exemplary embodiments, a plug 50 may be inserted into curved end 48. Once installed onto post 15, the post 15, snorkel 14 and plug 50 can cooperate to establish a transient initiator chamber 52

As initiator 26 is detonated, the initiator chamber 52 allows and provides a temporary "cocoon" of gas in the immediate vicinity of the initiator 26, which allows the initiator to fully activate (although the plug 50 may blow out). This configuration is advantageous for underwater applications and allows for complete detonation of the energetic material. Upon activation of the initiator 26, the energetic charge 24 in the upper housing 12 can be detonated, releasing a shockwave. Without wishing to be bound necessarily by any theory, it is believed the shockwave passes through gas contained in the energy-focusing guide 28 to compress, heat, and accelerate the gas in the direction of the shockwave front motion. The shockwave has an initial "detonation velocity". Detonation velocity is measured for the purposes of this invention in accordance with the technique set forth in John M. McAfee, Blaine W. Asay, A.

Wayne Campbell, John B. Ramsay, Proceedings *Ninth Symposium on Detonation*, OCNR 113291-7 pp. 265-278 (1989).

As the shockwave passes through energy-focusing guide 28 and encounters the gas 31, the shockwave may slow somewhat. However, the decreasing taper of the energy-focusing guide 28 and the deflagration chamber can stop the decrease in speed of the shockwave, and can even increase the speed of the shockwave. If the shockwave passing through the energy-focusing guide 28 has sufficient velocity to excite gas molecules into a reactive transition state, the gas 31 begins to undergo exothermic decomposition and can generate plasma. The velocity needed to generate plasma will depend primarily upon the ionization potential of the gas contained in the energy-focusing guide 28. Gas ionization potentials are reported in the *CRC Handbook of Chemistry and Physics*. For example, in the case of air, the detonation velocity and the effective velocity of the shockwave are generally at least about 7 mm/usec (millimeters per microsecond) and about 6 mm/usec, respectively. Other gases may have higher or slower ionization potential and require different effective velocities.

The velocity of the shockwave as it passes through the gas may be measured as follows. Fiber optic cables with a core diameter of about 250 μm are passed perpendicular to the length of the guide through both walls of the guide. One end of the fiber is connected to a laser and the other end is connected to a silicon photodiode. The fiber that is inside the guide has the low-index cladding removed, resulting in a fiber that is exposed to the atmosphere in the guide. Since the index-of-refraction of the atmosphere in the guide, initially air at ambient pressure, is considerably lower than the index-of-refraction of the fused silica core of the fiber, almost all of the laser light coupled to the fiber will remain in the fiber as is passes through the guide. However, when the higher-pressure shock wave passes by the fiber, the index-of-refraction of the air increases to the point that light begins to escape the fiber. This arrangement results in a measurable decrease in detected laser light as the shockwave passes the fiber optic. By placing a series of fiber optics at known locations along the length of the guide, the shock velocity in the guide can be calculated by dividing distance the fiber is from the energetic by the arrival time of the shock at the fiber.

In operation, the distal end 36 of the mine/UXO-neutralizing device 10 may, in an exemplary embodiment, be placed in contact with or immediately adjacent the explosive ordnance, which is depicted in the drawings as having a casing 40, and a primary explosive 54. Although not shown in the Figures, a holder or stand may be provided for mounting the device 10 in contact with or close proximity to the UXO 38. Optionally, a sealant (e.g., O-ring or epoxy) may be used to form a hermetic seal between the distal guide end 36 of the energy-focusing-guide 28 and the casing 32.

The configuration of the energy-focusing guide 18 efficiently captures and channels energy of the plasma on the casing 40. The high temperature plasma energy pulse impacts and penetrates through the casing 32 and enters into the primary explosive 54, where the plasma consumes all or most (in an exemplary embodiment, at least 90 weight percent) of the primary explosive 54 without or before causing an explosive event. In exemplary embodiments of the invention, the plasma leaves pulverized primary explosive remnants that are harmless or significantly less dangerous than the pre-neutralized UXO, thereby decreasing the risk of primary or collateral damage from the UXO.

Without wishing to be bound by any theory, it is believed that the plasma initiates deflagration in the explosive, e.g., TNT. Deflagration is a very fast burning mechanism where the burn rate increases as a function of time. This deflagration consumes the entire mass of TNT within a few milliseconds. In contrast, conventional methods consume TNT in a 'fast burn'. The burn rate of a fast burn is constant and is at least an order of magnitude or more slower than a deflagration, resulting in the consumption of the TNT taking seconds or longer.

Advantageously, the construction of the neutralizing devices of embodiments of the present invention require small amounts of energetic charges. For example, according to one experimental test, a mine including a 0.25 inch PVC casing and 4.5 pounds of TNT was neutralized (99 weight percent TNT consumption) in less than one second (about 1 to about 5 milliseconds) with a neutralizing device. The neutralizing device included a 1 inch diameter/1 inch long housing made of plastic (e.g., acrylic). The housing was loaded with 20 grams of energetic charge comprising 88 weight percent HMX and 12 weight percent binder (5.365 weight % HTPB, 5.365 weight % IDP (isodecylpelarglonate), 0.51 weight % IPDI (isophorone diisocyanate), 0.7 weight % lecithin. The neutralizing device further comprised a polycarbonate cone selected as the energy-focusing guide. The guide had a length of 3 inches and an deflagration chamber tapering continuously in diameter from 0.5 inches to 1.0 inches. An epoxy adhesive was used to join the distal end of the energy-focusing guide to the ordnance. The non-consumed explosive remnants totaled 1 ounce and were pulverized in the method to particle sizes less than 5 $mm^3$, and more particularly less than 1 $mm^3$.

Without wishing to be bound by any theory, it is believed that the energy-focusing device is primarily responsible for increasing the efficiency of energy delivery to the target so that smaller amounts of energetic charge are required. The neutralizing device 10 may be manufactured as follows. Initiator 16 is inserted through an aperture in the closed end of housing 12. Adhesives, mechanical fasteners, tape, or the like may be used to retain the initiator 16 in place. In an exemplary embodiment, the upper housing 12 may be coupled, with a hermetic seal, to the energy-focusing guide 28 using adhesive (e.g., epoxy), mechanical fasteners, or the like. The order for inserting initiator 26, loading the energetic charge 24, and coupling the energy-focusing guide 28 is not particularly important, and may be practiced in any sequence.

The neutralizing device and method of the present invention have a wide range of utilities. For example, it is contemplated that the device and method may be practiced in many and diverse environments where mines and UXO are encountered, such as ground, underground, underwater, and overburden. Further, the neutralizing device of embodiments of the invention is compatible with and will penetrate through most common casing materials, such as steel, aluminum, plastic, and other casings. The relatively inexpensive and compact nature of the device and the simplicity with which it operates makes the present invention ideal for security and humanitarian purposes, such as for neutralizing mines in military and civilian areas. The device also has utility in neutralizing vehicle-based mines and underwater mines.

Referring now to FIG. 4, a block diagram 60 is shown, which can illustrate the methods of several embodiments of the invention is shown. As shown, the method 60 can include the initial step 62 of providing an energy-focusing guide 28 and connecting the upper housing 12 to energy-focusing guide 28 (step 64). The methods can further include the step 66 of placing an energetic charge 24 in tapered void 66, and inserting an initiator 26 through opening and into tapered void 68, so that the initiator contacts the energetic charge. Finally, the methods can include the step 70 of establishing a transient initiator chamber 52 with snorkel 14, and detonating the energetic charge. These methods steps are accomplished using the structure and cooperation of structure described above.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

What is claimed is:

1. An unexploded ordnance (UXO) mitigation device, comprising:

an energy-focusing guide;

an upper housing being connected to said energy-focusing guide, wherein said upper housing is formed with an opening and a tapered void, and wherein said opening is merged into said tapered void;

an initiator being inserted into said opening; and, a snorkel being attached to said upper housing.

2. The device of claim 1, wherein said snorkel further comprises a straight part having a proximal end and a distal end, wherein said straight part merges into a curved part at said distal end, wherein said curved part terminates at a curved end, and wherein said snorkel is attached to said upper housing at said proximal end.

3. The device of claim 2, further comprising a plug being inserted into said curved end.

4. The device of claim 1, further comprising an energetic charge being inserted into said tapered void, wherein said explosive is in contact with said initiator.

5. The device of claim 4, wherein the energetic charge comprises at least 94 weight percent of a nitramine.

6. The device of claim 4 wherein the energetic charge comprises at least 94 weight percent of a nitramine, and wherein said nitramine is selected from HMX, RDX, PETN, EGDN, NG, TNT, DADNE, NTO, CL-20 and TMZ.

7. The device of claim 2, further comprising a plug being inserted into said curved end, wherein said snorkel and said plug cooperate to establish a combustion chamber, and wherein said combustion chamber contains a gas selected from air, hydrogen, helium, argon, oxygen, and nitrogen.

8. The device of claim 1, wherein said energy-focusing guide defines a deflagration chamber having a maximum width proximate said upper housing and a minimum width distal said upper housing.

9. An underwater unexploded ordnance (UXO) mitigation device, comprising:

an inverted snorkel including a curved part and a straight part, wherein said straight part includes a proximal end and a distal end that merges into said curved part, and wherein said curved part terminates at a curved end;

an upper housing being connected to said inverted snorkel, wherein said upper housing is formed with an opening;

an initiator being inserted into said opening, wherein said upper housing is further formed with a conical void, wherein said conical void merges into said opening, wherein said conical void includes an increasing taper when viewed in cross-section from a minimum width proximate said opening and a maximum width distal said conical void; and, an energy-focusing guide being attached to said upper housing, wherein said energy-focusing guide formed with a deflatration chamber, which merges into said conical void, wherein said initiation chamber includes a decreasing taper to a maximum chamber width proximate said upper housing to a minimum chamber width distal said upper housing.

10. The device of claim 9, further comprising a plug being inserted into said curved end.

11. The device of claim 9, further comprising an energetic charge being inserted into said conical void, wherein said energetic charge in contact with said initiator.

12. The device of claim 11, wherein said energetic charge comprises at least 94 weight percent of a nitramine.

13. The device of claim 11, wherein said energetic charge comprises at least 94 weight percent of a nitramine, and wherein said nitramine is selected from HMX, RDX, PETN, EGDN, NG, TNT, DADNE, NTO, CL-20 and TMZ.

14. The device of claim 10, wherein said plug establishes a combustion chamber, and wherein said combustion chamber containing a gas selected from air, hydrogen, helium, argon, oxygen, and nitrogen.

15. The device of claim 9, wherein said energy-focusing guide defines a conical combustion chamber having a maximum width proximate said upper housing, which tapers to a minimum width distal said upper housing.

16. The device of claim 15, wherein said energetic charge comprises a material that, when activated, establishes an initial detonation velocity of at least 7 mm/μsec in said combustion chamber.

17. A method for deflagration of underwater unexploded ordinance (UXO), comprising:

providing an energy-focusing guide;

connecting an upper housing being connected to said energy-focusing guide, wherein said upper housing is formed with an opening and a tapered void, and wherein said opening merges into said tapered void;

placing an energetic charge in said tapered void;

inserting an initiator through said opening and into said void so that said initiator is in contact with said void; and, establishing a transient chamber for said initiator with an inverted snorkel attached to said upper housing.

18. The method of claim 17, wherein said placing is accomplished with a material selected from HMX, RDX, PETN, EGDN, NG, TNT, DADNE, NTO and TMZ.

19. The method of claim 17, wherein said establishing further comprises a plug placed in said curved end.

20. The method of claim 17, further comprising detonating said energetic charge with said initiator for establishing a shock wave in said energy-focusing guide, wherein said energy-focusing guide defines a deflagration chamber, and wherein said shock wave includes an initial detonation velocity of at least 7 mm/μsec.

* * * * *